United States Patent [19]

Iwasa et al.

[11] 4,144,808

[45] Mar. 20, 1979

[54] ELECTROPHOTOGRAPHIC MARKING APPARATUS

[75] Inventors: Masakazu Iwasa, Tokyo; Seiji Matsumoto; Satoru Honjo, both of Asaka; Teruo Iida, Minami-ashigara, all of Japan

[73] Assignee: Fuji Photo Film Co., Ltd., Minami-ashigara, Japan

[21] Appl. No.: 806,702

[22] Filed: Jun. 15, 1977

[30] Foreign Application Priority Data

Jun. 16, 1976 [JP] Japan ..... 51-70484
Jun. 16, 1976 [JP] Japan ..... 51-70486

[51] Int. Cl.[2] ..... G03G 15/00

[52] U.S. Cl. ..... 101/1; 101/41; 101/DIG. 13; 355/3 R; 355/3 BE; 355/3 TR

[58] Field of Search ..... 101/1, 36, DIG. 13, 101/41; 355/3 TR, 3 R, 3 BE

[56] References Cited

U.S. PATENT DOCUMENTS

| | | | |
|---|---|---|---|
| 3,220,833 | 11/1965 | McFarlane | 101/DIG. 13 |
| 3,257,222 | 6/1966 | Carlson | 101/DIG. 13 |
| 3,345,944 | 10/1967 | Simmons | 101/DIG. 13 |
| 3,487,775 | 1/1970 | Chaney et al. | 101/DIG. 13 |
| 3,591,276 | 7/1971 | Byrne | 355/3 X |
| 3,653,758 | 4/1972 | Trimmer et al. | 355/3 TR X |
| 3,893,761 | 7/1975 | Buchan et al. | 355/3 TR |
| 3,923,392 | 12/1975 | Buchan et al. | 355/3 TR |

FOREIGN PATENT DOCUMENTS

| | | | |
|---|---|---|---|
| 932788 | 8/1973 | Canada | 355/3 TR |
| 2280115 | 3/1976 | France | 355/3 TR |

*Primary Examiner*—E. H. Eickholm
*Attorney, Agent, or Firm*—Fleit & Jacobson

[57] ABSTRACT

An electrophotographic print marking apparatus for printing markings on rolled steel plates while the steel plates are being fed in a heated condition. A part of an image transfer belt which is brought to a transfer section where the powder image carried by the belt is transferred to the steel plate is made movable up and down by means of a pair of lower rollers. The rollers are moved up and down to bring the part of the belt in the transfer section close the steel plates when the powder image is transferred to the steel plates and to separate the belt far apart from the steel plates when the powder image is not transferred. A tension roller is provided to absorb the change in tension of the transfer belt accompanying the up and down movement of the lower rollers.

16 Claims, 6 Drawing Figures

ELECTROPHOTOGRAPHIC MARKING APPARATUS

CROSS-REFERENCES TO RELATED APPLICATIONS

This application relates to subject matter similar to that disclosed in co-pending U.S. application Ser. No. 788,464.

BACKGROUND OF THE INVENTION

1. Field of the Invention

This invention relates to a marking apparatus, and more particularly to an apparatus for printing markings on rolled steel plates while the steel plates are being fed in a heated condition by means of an electrophotographic process.

2. Description of the Prior Art

In an iron and steel mill, various kinds of information such as the name of the manufacturer, the destination of shipment, the dimensions of the steel plates, the date of the manufacturing and so forth are printed in the form of marking on the successively manufactured steel plates. In a rolling mill, the rolled steel plates are fed out of a rolling machine in a heated condition. Therefore, the markings are printed on the heated plates by use of a stencil on to which a heat resisting coating material is sprayed. Since the marking process is normally done by hand, the efficiency thereof is very low.

On the other hand, it has been known in the art to print markings on cooled steel plates by use of electrophotography. However, it is difficult to apply the electrophotographic print marking process in a rolling mill where the rolled steel plates are successively fed in a heated condition. This is particularly so because the rolled steel plates in a rolling mill are normally heated up to 300° to 500° C. and are not of constant thickness. Further, the surface of the steel plates is apt to vibrate up and down as they are fed. This makes it very difficult to transfer an electrostatic powder image to the surface of the steel plates. If the conventional electrophotographic print marking apparatus is simply applied to the print marking process in rolling mill, the surface of the electrophotographic recording material on which a powder image is formed is likely to be damaged by the heat of the steel plates and the quality of the image transferred to the steel plates will be degraded by the vibration of the steel plates resulting in contact of the powder image formed thereon with the surface of the recording material. Further, the heat of the rolled steel plates will damage the developer in which the toner is contained and an image forming section which forms an electrostatic latent image on the electrophotographic recording material. In order to prevent the above mentioned damages caused by the heated rolled steel plates, it is demanded that the image recording material and the latent image forming section be located apart from the steel plates and the powder image carrying member be moved close to the steel plates only when the powder image is to be transferred to the steel plates. Further, the amount of the movement of the powder image carrying member toward the steel plates is desired to be controlled in accordance with the thickness of the steel plates. However, if the whole apparatus is simply moved up and down, a large scale complicated means for moving up and down the apparatus is needed.

SUMMARY OF THE INVENTION

In view of the problems as mentioned hereinabove, it is the primary object of the present invention to provide a marking apparatus which is capable of printing markings of high quality on steel plates while the steel plates are being fed in a heated condition.

Another object of the present invention is to provide an electrophotographic print marking apparatus wherein an electrostatic powder image of high quality can be formed on steel plates while the steel plates of different thickness are being fed successively in a heated condition.

Still another object of the present invention is to provide an electrophotographic print marking apparatus wherein an electrostatic powder image of high quality can be formed on steel plates while the steel plates are being fed in a heated and vibrated condition.

A further object of the present invention is to provide an electrophotographic print marking apparatus wherein the mechanically sensitive portions of the apparatus are protected from vibration of the steel plates on which the markings are to be printed.

A still further object of the present invention is to provide an electrophotographic print marking apparatus wherein a part of the powder image carrying member is moved apart from and close to steel plates on which the markings are to be printed by means of a simple mechanism.

The electrophotographic print marking apparatus in accordance with the present invention is characterized in that an endless belt is provided between an electrophotographic recording material on which a powder image is formed and the steel plates and a part of the endless belt is guided along the surface of the steel plates being tensioned between a pair of rollers which are made movable up and down to vary the spacing between the endless belt therebetween and the surface of the endless belt. The pair of rollers are moved upward together apart from the surface of the steel plates to make the endless belt separated far apart from the surface of the heated steel plates when the image is not transferred from the endless belt to the steel plates. When the powder image carried on the endless belt is transferred to the steel plates, the pair of rollers are moved downward close to the steel plates to make the endless belt run close to the steel plates.

Since the endless belt is fed apart from the steel plates when the powder image is not transferred to the steel plates, the endless belt is protected from the heat of the steel plates. Further, since the endless belt is separated far apart from the steel plates, the mechanically sensitive portions of the apparatus is protected from the vibration of the steel plates and from the fluctuation in thickness of the steel plates.

In a preferred embodiment of the present invention, the endless belt provided between the electrophotographic recording material and the steel plates is tensioned around a tension roller as well as said pair of movable rollers. Further, the endless belt is tensioned around a drive roller. The tension roller acts to absorb the slack of the endless belt when the pair of rollers are moved upward to separate the lower part of the endless belt far apart from the steel plates.

The endless belt may be provided between the electrophotographic recording material and the steel plates to act as an intermediate medium, or may be used an an image recording material as well. In this case, a latent image is formed on the endless belt and a powder image is formed thereon by developing the latent image and the powder image is transferred from the endless belt to the steel plates. From the viewpoint of protection of the image recording material, it is desirable that the endless belt should be used as an intermediate medium. When the endless belt is used as the intermediate medium, a high potential is applied between the recording material and the endless belt when the powder image is transferred from the image recording material to the endless belt, and a high potential of reverse polarity is applied between the endless belt and the steel plates when the powder image is transferred from the endless belt to the steel plates. Thus, the endless belt is subjected to the potentials of reverse polarities. Therefore, in such a case, the endless belt is separated from the image recording material when the reverse potential is applied between the endless belt and the steel plates for transfer of the image to the steel plates.

Therefore, in a preferred embodiment of the present invention, an endless belt is tensioned around a drive roller, a tension roller, a pair of movable rollers and another movable roller which is moved to separate the endless belt from the image recording material when the endless belt is moved close to the steel plates.

PREFERRED EMBODIMENTS OF THE INVENTION

Figure 1:
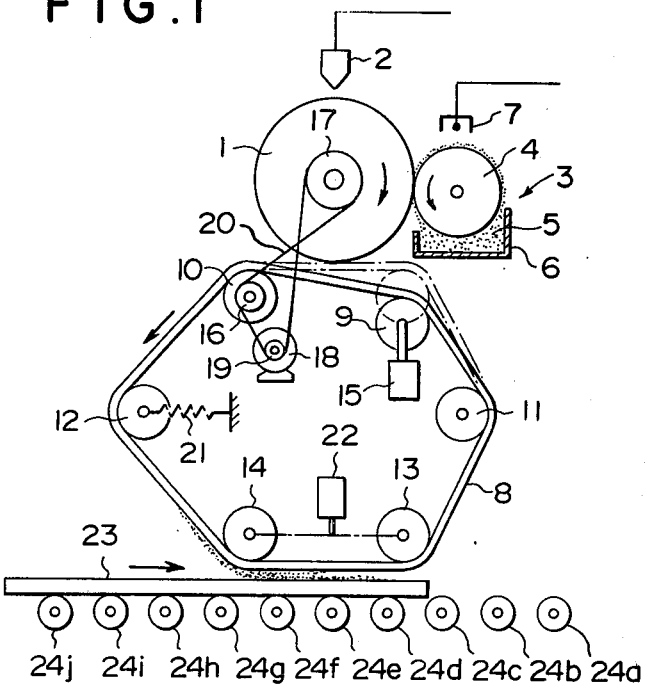
FIG. 1 is a side view of a marking apparatus in accordance with an embodiment of the present invention.

Now a preferred embodiment of the present invention will be described in detail with reference to FIG. 1. In this embodiment, a recording drum 1 made of an electric insulating material backed with a conductive electrode is used as an image recording member on which an electrostatic latent image is recorded. In more detail, the drum 1 is composed of a metal drum made of a heat resistive metal and a heat resistive highly insulating layer applied thereon. The drum 1 may be replaced by an endless belt. The image recording drum 1 is rotatably mounted on a shaft and rotated in the direction indicated by an arrow. An electrostatic recording needle 2 is located in the vicinity of the surface of the drum 1 to record marking information by forming an electrostatic latent image on the insulating surface of the drum 1. In the practical marking apparatus a series of the electrostatic recording needles 2 are arranged along the surface of the drum 1 in the direction of the axis of rotation of the drum 1 and are selectively energized to record the information in a pattern constituted of a number of dots.

The electrostatic latent image formed on the recording drum 1 is developed by a developer 3. The developer 3 is comprised of a developing roller 4, a toner container 6 containing a toner 5 and a corona charger 7. The toner 5 is a fine powder of mixture of pigments and resins. When the surface of the steel plates is dark, the toner is of white or light color. The toner 5 sticks on the surface of the roller 4 and is charged by the corona charger 7 and then sticks on the surface of the drum 1 in the area of the electrostatic latent image to develop the same into a powder image. The developing roller 4 is rotated in the direction as shown by an arrow at the same peripheral speed as that of the recording drum 1.

By the developer 3, the latent image is developed into the powder image on the drum 1 and then the powder image is transferred to a transfer belt 8 where the surface of the drum 1 contacts the surface of the transfer belt 8. The transfer belt 8 is an endless belt made of a flexible metal belt as of stainless steel having coated thereon an insulating layer. The transfer belt 8 is provided between the recording drum 1 and the steel plates to protect the drum 1 from heat.

The transfer belt 8 in the endless form is tensioned around an upper roller 9, a drive roller 10, a twist correcting roller 11, a tension roller 12, and a pair of lower rollers 13 and 14 in a hexagonal shape. These rollers are rotatably mounted on shafts which are parallel to each other and are perpendicular to the direction of feed of the steel plates.

The upper roller 9 is connected with a moving means 15 so that the upper roller 9 is moved downward to separate the upper portion of the transfer belt 8 from the recording drum 1 while the powder image is transferred to the steel plates.

The drive roller 10 is provided with a pulley 16. The drum 1 is also provided with a pulley 17 at its axis. A motor 18 having a pulley 19 is stationarily provided in the vicinity of the drive roller 10 and an endless belt 20 is tensioned around the pulleys 16, 17 and 19 to rotate the drive roller 10 and the recording drum 1 together in the same direction.

The twist correcting roller 11 has a revolution axis which is finely adjustable to vary the angle of the roller with respect to the transfer belt 8 to correct the twist of the belt 8.

The tension roller 12 located between the drive roller 10 and the lower roller 14 is provided with a tension control means 21 such as a compression spring to absorb the change in tension of the transfer belt 8 and maintain the constant tension.

The pair of lower rollers 13 and 14 are made movable up and down by means of a moving means 22 which is operated to move the rollers 13 and 14 downward only when the powder image on the transfer belt 8 is transferred to the steel plates. Upon completion of the transfer of the image, the moving means 22 operates to move the rollers 13 and 14 upward to protect the transfer belt 8 from the heat of the steel plates. Further, the amount of the downward movement of the rollers 13 and 14 is controlled according to the thickness of the steel plates so that the lower surface of the transfer belt 8 is spaced from the steel plates by a predetermined distance. Since the lower surface of the transfer belt 8 is spaced from the steel plates, the mechanical vibration of the steel plates is not transmitted to the belt 8 and the mechanisms connected with the transfer belt 8 is protected from the vibration.

The steel plates on which the powder image is to be transferred is designated by the reference numeral 23 in the drawing. Under the transfer belt 8 are provided a number of feed rollers 24*a*–24*j* to feed the steel plates 23 fed out of a rolling mill in the direction as indicated by an arrow. The speed of travel of the steel plates 23 fed by the feed rollers 24*a*–24*j* is made equal to that of the surface of the transfer belt 8. While the steel plates 23 are fed in parallel to the transfer belt 8 at the same speed as that of the transfer belt 8, the lower portion of the transfer belt 8 is subjected to an electric potential and an ultrasonic vibration to effectively transfer the powder image from the transfer belt 8 to the steel plates 23.

Further, it will be understood that the powder image carried on the transfer belt 8 can be transferred to the steel plates 23 by a contact transfer process in which the transfer belt 8 is fed in contact with the steel plates 23.

In operation, the motor 18 is driven to rotate the drive roller 10 and the image recording drum 1 by way of the endless belt 20. By the drive roller 10 the transfer belt 8 is driven to run in the direction of the arrow at the same speed as the peripheral speed of the image recording drum 1. Simultaneously, the feed rollers 24*a*–24*j* and the developing roller 4 are rotated. Further, the marking information is recorded on the image recording drum 1 as an electrostatic latent image by means of the recording needles 2. The latent image formed on the recording drum 1 is brought to the developer 3, where the latent image is developed with the toner 5 carried on the developing roller 4 and charged by the corona charger 7.

Figure 2:
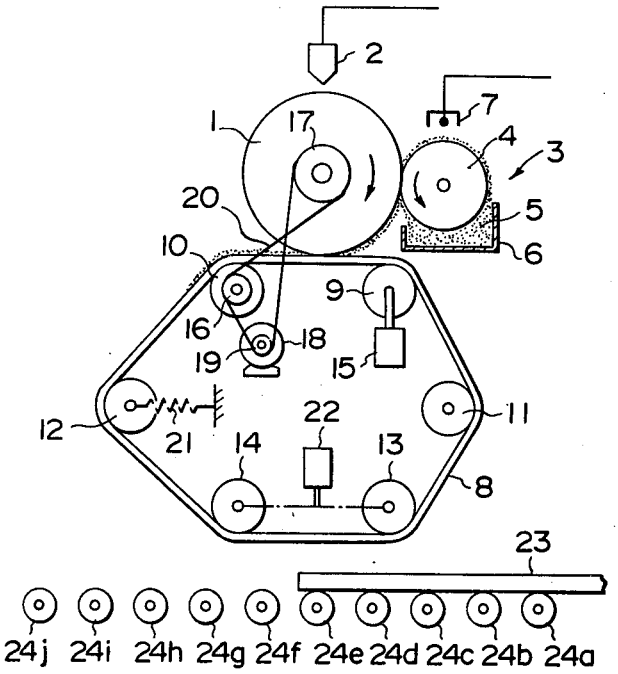
FIG. 2 is a side view of the marking apparatus as shown in FIG. 1 which is in the state where a powder image is transferred from an image recording material to the endless belt.

As shown in FIG. 2, when the powder image carried by the recording drum 1 transferred from the recording drum 1 to the transfer belt 8, the upper portion of the transfer belt 8 is put into contact with the surface of the drum 1 by the moving means 15 and a high potential is applied between the drum 1 and the belt 8 to effectively transfer the powder image to the belt 8.

When the powder image transferred to the belt 8 is brought to the lower portion of the belt 8, the steel plate 23 is brought to the transfer station as shown in FIG. 1 where the powder image on the transfer belt 8 is transferred to the steel plate 23. When the steel plate 23 comes to the transfer section, the moving means 22 is operated to move the pair of lower rollers 13 and 14 downward to bring the lower portion of the belt 8 close to the surface of the steel plate 23. Simultaneously, the upper portion of the transfer belt 8 is separated from the recording drum 1 by the moving means 15. At this stage, the surface of the transfer belt 8 is spaced from the surface of the steel plate 23 at a predetermined small distance. As the steel plate 23 runs at the same speed as the running speed of the transfer belt 8, the powder image on the belt 8 is transferred to the steel plate 23 by applying an ultrasonic vibration and a high potential to the transfer section. Since the steel plate 23 is in a heated condition, the toner is fused by the heat and the powder image is fixed to the surface of the steel plate 23.

When the transfer is completed, the moving means 22 operates to move the lower portion of the transfer belt upward by moving the pair of lower rollers 13 and 14 upward as shown in FIG. 2. Thus, the transfer belt 8 is protected from the heat and the vibration of the steel plate 23. Since the tension of the transfer belt 8 is changed when the lower portion thereof is moved upward, the tension roller 12 is moved to absorb the slack of the belt 8 and maintain a constant tension in the belt 8.

It is desired that the moving means 22 be operated to keep a constant gap between the lower surface of the transfer belt 8 and the surface of the steel plate 23. If this is done, a stable transfer of image is effected and the markings of high quality can be obtained.

Figure 3:
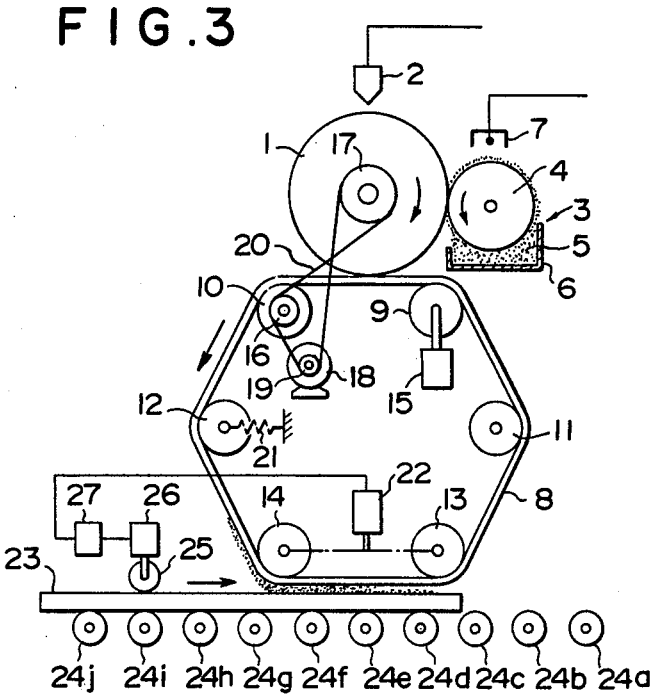
FIG. 3 is a side view of a marking apparatus in accordance with another embodiment of the present invention in which the level of a part of the endless belt facing the steel plates is controlled according to the thickness of the steel plates.

One example of such modifications will hereinbelow be described in detail with reference to FIG. 3. A surface level detector roller 25 rolling on the surface of the steel plates 23 is connected with a potentiometer 26 to convert the level of the surface of the steel plates 23 to an electric signal. The potentiometer 26 is connected with a delay circuit 27 which is connected with said moving means 22. The delay circuit 27 acts to delay the transmission of the signal from the potentiometer 26 to the moving means 22 by a time corresponding to the time during which the steel plate 23 is fed from the position of the level detector roller 25 to the image transfer section where the powder image is transferred from the belt 8 to the steel plate 23. By the delayed signal, the moving means 22 is operated to move the pair of rollers 13 and 14 up or down to keep the predetermined gap between the belt 8 and the steel plate 23.

In case that the powder image is transferred to the steel plate 23 by a contact transfer process, the moving means 22 is made free to have the rollers 13 and 14 press the belt 8 on the surface of the steel plates 23 by the gravity thereof so that the rollers 13 and 14 be moved up and down accompanying the change in thickness of the steel plates 23. The change in tension of the belt 8 is absorbed by the tension roller 12.

Figure 4:
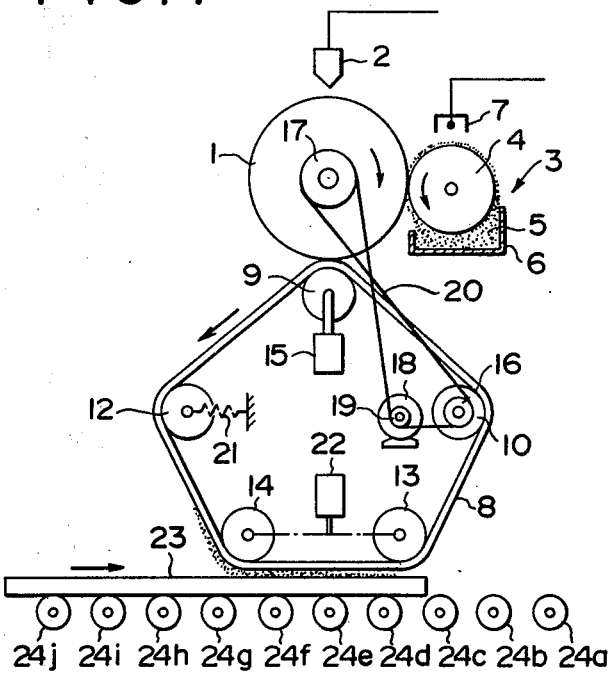
FIG. 4 is a side view of a marking apparatus in accordance with still another embodiment of the present invention in which the endless belt is fed in a pentagonal path.

FIG. 4 shows another embodiment of the present invention in which the transfer belt 8 is tensioned in a pentagonal shape. In this embodiment, a twist correcting roller is combined with a tension roller 12 or a drive roller 10, and the drive roller 10 is located on the right and the upper roller 9 is located under the recording drum 1 as shown. All the other elements are equivalent to those employed in the above described embodiments and designated by the same reference numerals, and accordingly the detailed description thereof is omitted here.

In the foregoing embodiments, the electrostatic latent image is once recorded on the recording drum 1 and then is transferred to a transfer belt 8. Therefore, the apparatus is protected from a mechanical shock and a heat. However, on the other hand, the structure of the apparatus becomes complicated by the provision of the transfer belt 8. In view of this, when the temperature of the steel plates 23 is not so high, it is desired sometimes desired that the electrostatic latent image be directly recorded on the transfer belt 8.

Figure 5:
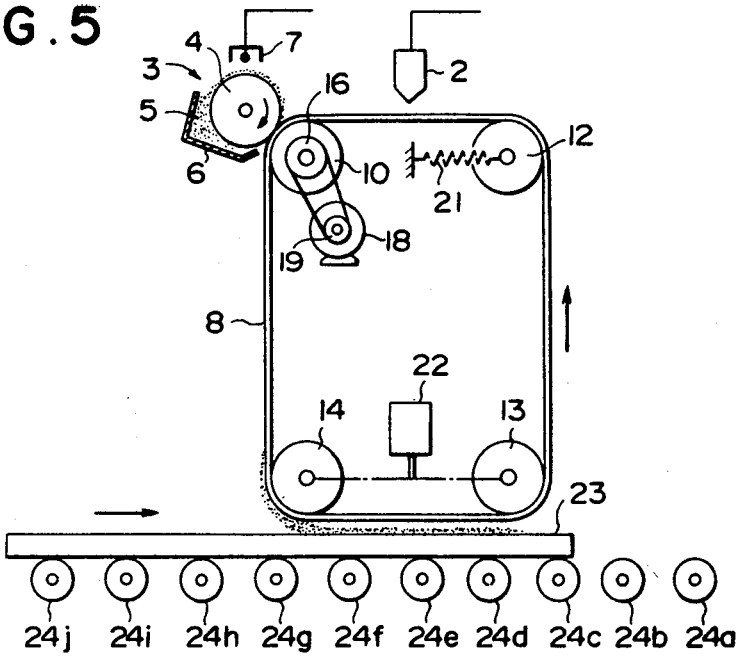
FIG. 5 is a side view of a marking apparatus in accordance with a further embodiment of the present invention in which the endless belt is fed in a rectangular path and a powder image is directly formed on the endless belt.

One example of such modifications will be described referring to FIG. 5. A drive roller 10 and a tension roller 12 are located at the same level and a pair of lower rollers 13 and 14 are located thereunder at the same level so that a transfer belt 8 travels in a rectangular path. Between the drive roller 10 and the tension roller 12 is located an electrostatic recording needle array 2, and a developing roller 4 is rotated in contact with the belt 8 at the drive roller 10. Thus, the electrostatic latent image formed on the belt 8 by the needle array 2 is developed into a powder image by the developing roller 4 when the latent image carrying portion of the belt 8 passes through the developing roller 4 and the drive roller 10. The other elements are all equivalent to those employed in the embodiments described hereinabove, and accordingly the description thereof is omitted here.

Figure 6:
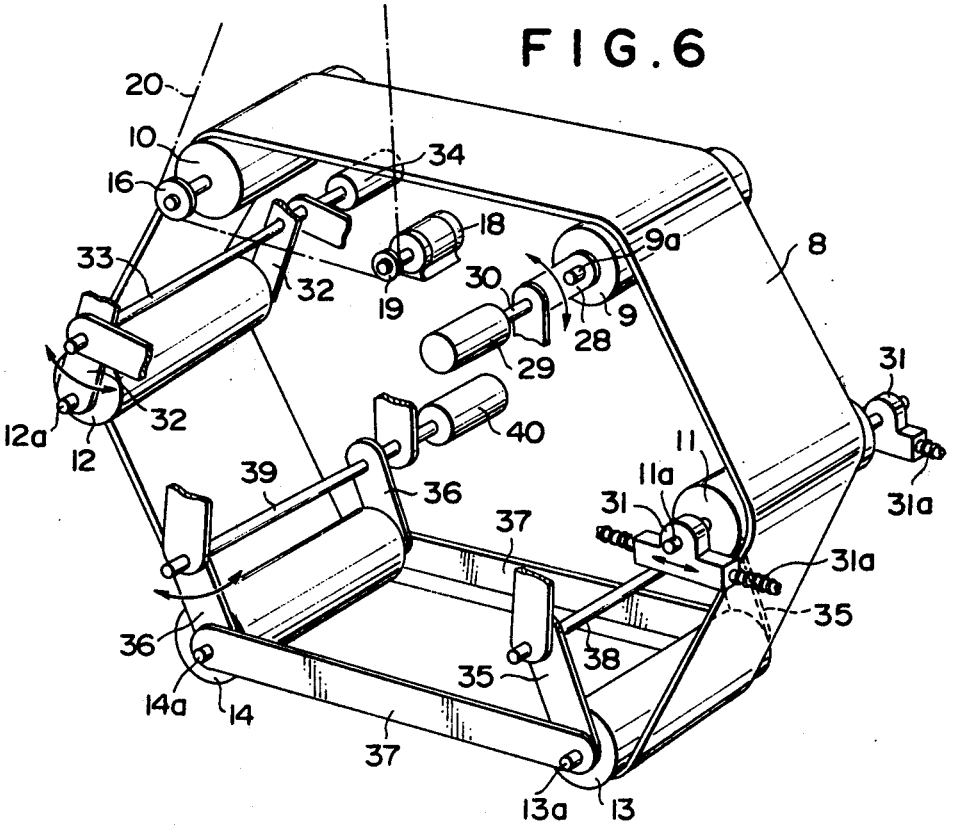
FIG. 6 is a perspective view of a marking apparatus in accordance with still another embodiment of the present invention in which the endless belt is fed in a hexagonal path and a pair of lower rollers are made movable up and down by means of a parallelogram shaped linkage.

A concrete structure of the belt driving and tension controlling system as employed in the first embodiment shown in FIG. 1 will hereinbelow be described in detail with reference to FIG. 6. A transfer belt 8 is tensioned around six rollers in a hexagonal shape. An upper roller 9 has a revolution shaft 9*a* which is supported by a pair of arms 28 (only one of the pair shown) fixed to a shaft 30 of an actuator 29. The actuator 29 operates to rotate the arms 28 by oil pressure or the like to move the upper roller 9 about the shaft 30 and move the upper portion of the transfer belt 8 up and down.

Below the upper roller 9 is provided a twist correcting roller 11 having a revolution shaft 11*a* supported by a pair of bearings 31. The bearings 31 are screw-engaged with parallel screw rods 31*a* so that the bearings 31 are moved back and forth be revolving the screw rods 31*a*. The screw rods 31*a* can be revolved independently of each other so as to change the angle of the axis of revolution of the twist correcting roller 11. For instance, when the transfer belt 8 is moved to the right when viewed from right, the right hand side of the twist correcting roller 11 is moved outwardly to move the belt 8 leftward.

To the left of the upper roller 9 is provided a drive roller 10 having a pulley 16. A drive belt 20 is tensioned around the pulley 16 and a pulley 19 of a motor 18 to rotate the drive roller 10. Below the drive roller 10 is provided a tension roller 12 which has a revolution shaft 12*a* supported by a pair of arms 32 fixed to a shaft 33 of an actuator 34. The actuator 34 operates to rotate the arms 32 by oil pressure or the like in one direction to apply a predetermined constant tension to the transfer belt 8 from inside of the endless transfer belt 8 as shown.

Below the twist correcting roller 11 and the tension roller 12 a pair of lower rollers 13 and 14 are provided. The lower rollers 13 and 14 have revolutions axes 13*a* and 14*a* which are supported by pairs of arms 35 and 36 respectively. The pairs of arms 35 and 36 are connected with each other by way of a pair of parallel links 37 to form a parallelogram linkage. The pairs of arms 35 and 36 are fixed to shafts 38 and 39 respectively. One shaft 39 is connected to an actuator 40 to be rotated thereby. The actuator 40 is operated by oil pressure or the like controlled by an electric signal of a level detector roller by way of a delay circuit or by an external manual operation. The actuator 40 operates to rotate the arms 36 and the rotation of the arms 36 is transmitted to the other pair of arms 35 by way of the links 37, thereby moving the lower rollers 13 and 14 obliquely upward and downward.

We claim:

1. An apparatus for print marking steel plates while the steel plates are being fed in a heated condition comprising an endless transfer belt tensioned around a plurality of rollers including a drive roller, means for forming a powder image on the surface of the endless belt, and means for transferring the powder image formed on the surface of the endless belt to the surface of the steel plates, wherein the improvement comprises at least two rollers provided for guiding a part of said transfer belt in parallel to the surface of the steel plates in an image transfer station where the powder image on the belt is transferred to the steel plates, and means for moving said guiding rollers up and down to move the belt apart from and close to the steel plates.

2. An apparatus for print marking steel plates as defined in claim 1 wherein said means for moving said guiding rollers up and down comprises a parallelogram linkage for moving said guiding rollers up and down together.

3. An apparatus for print marking steel plates as defined in claim 1 wherein said means for moving said guiding rollers up and down is connected with a level detecting means for detecting the surface level of the steel plates, whereby the level of the guiding rollers are controlled according to the level of the steel plates so that a predetermined gap is constantly formed between the transfer belt in the transfer station and the steel plates.

4. An apparatus for print marking steel plates as defined in claim 3 wherein said level detecting means gives an electric output indicative of the level of the steel plates.

5. An apparatus for print marking steel plates as defined in claim 4 wherein a delay means is connected between the level detecting means and the means for moving said guiding rollers up and down, and said level detecting means is provided to detect the level of the steel plates upstream the transfer section.

6. An apparatus for print marking steel plates as defined in claim 1 wherein said plurality of rollers around which the endless belt is tensioned include a tension roller which is urged to tension the transfer belt and acts to absorb the change in tension of the tranfer belt.

7. An apparatus for print marking steel plates as defined in claim 6 wherein said tension roller is spring urged to tension the transfer belt.

8. An apparatus for print marking steel plates as defined in claim 6 wherein said tension roller is urged to tension the transfer belt by means of oil pressure.

9. An apparatus for print marking steel plates as defined in claim 1 wherein said plurality of rollers around which the endless belt is tensioned include a movable roller which is movable to move a part of the transfer belt apart from the transfer belt in the transfer station into contact with and apart from a powder image carrying means.

10. An apparatus for print marking steel plates as defined in claim 9 wherein said movable roller moves the transfer belt apart from the powder image carrying means when the powder image carried by the transfer belt is transferred to the steel plates.

11. An apparatus for print marking steel plates as defined in claim 2 wherein said means for moving said guiding rollers up and down is connected with a level detecting means for detecting the surface level of the steel plates, whereby the level of the guiding rollers are controlled according to the level of the steel plates so that a predetermined gap is constantly formed between the transfer belt in the transfer station and the steel plates.

12. An apparatus for print marking steel plates as defined in claim 11 wherein said level detecting means gives an electric output indicative of the level of the steel plates.

13. An apparatus for print marking steel plates as defined in claim 12 wherein a delay means is connected between the level detecting means and the means for moving said guiding rollers up and down, and said level detecting means is provided to detect the level of the steel plates upstream the transfer section.

14. An apparatus for print marking steel plates as defined in claim 2 wherein said plurality of rollers around which the endless belt is tensioned include a tension roller which is urged to tension the transfer belt and acts to absorb the change in tension of the transfer belt.

15. An apparatus for print marking steel plates as defined in claim 14 wherein said tension roller is urged to tension the transfer belt by means of oil pressure.

16. An apparatus for print marking steel plates as defined in claim 2 wherein said plurality of rollers around which the endless belt is tensioned include a movable roller which is movable to move a part of the transfer belt apart from the transfer belt in the transfer station into contact with and apart from a powder-image carrying means.

* * * * *